US012727664B2

(12) United States Patent
Bruder et al.

(10) Patent No.: US 12,727,664 B2
(45) Date of Patent: Sep. 8, 2026

(54) TABLE FRAME AND TABLE

(71) Applicant: Veyhl GmbH, Neuweiler (DE)

(72) Inventors: Wolfgang Bruder, Simmersfeld (DE); Horst Schober, Neuweiler (DE)

(73) Assignee: Veyhl GmbH, Neuweiler (DE)

( * ) Notice: Subject to any disclaimer, the term of this patent is extended or adjusted under 35 U.S.C. 154(b) by 0 days.

(21) Appl. No.: 18/175,000

(22) Filed: Feb. 27, 2023

(65) Prior Publication Data

US 2023/0210252 A1 Jul. 6, 2023

Related U.S. Application Data

(63) Continuation of application No. PCT/EP2021/072778, filed on Aug. 17, 2021.

(30) Foreign Application Priority Data

Sep. 2, 2020 (DE) ..... 10 2020 211 087.5

(51) Int. Cl.
*A47B 3/08* (2006.01)
*A47B 13/02* (2006.01)
*A47B 13/06* (2006.01)

(52) U.S. Cl.
CPC ..... *A47B 3/08* (2013.01); *A47B 13/02* (2013.01); *A47B 13/021* (2013.01); *A47B 13/06* (2013.01); *A47B 2003/0821* (2013.01); *A47B 2200/0013* (2013.01)

(58) Field of Classification Search
CPC ..... A47B 3/08; A47B 13/02; A47B 13/021; A47B 13/06; A47B 2003/0821; A47B 2200/0013
USPC ..... 248/188.1
See application file for complete search history.

(56) References Cited

U.S. PATENT DOCUMENTS 2,690,369 A * 9/1954 Laskey ..... A47B 3/0818 403/65
2,967,585 A * 1/1961 Bybee ..... E04G 1/32 182/186.3
3,113,793 A * 12/1963 Harwood ..... A47C 3/28 248/161
3,267,886 A * 8/1966 Glass ..... A47B 3/0812 108/127
3,796,169 A * 3/1974 Bales ..... A47B 3/0815 248/188.8

(Continued)

FOREIGN PATENT DOCUMENTS

CN 208597841 U * 3/2019 ..... A47B 13/003
CN 109996466 A * 7/2019 ..... A47B 13/021

(Continued)

*Primary Examiner* — Taylor Morris
(74) *Attorney, Agent, or Firm* — Orbit IP, LLP; Marc G. Martino

(57) ABSTRACT

A table frame has a table leg with a housing part, a longitudinal beam and a transverse beam having two mutually opposite edge portions. A longitudinal beam protrusion of the longitudinal beam can be brought into contact, under preload, with one of the edge portions. A housing protrusion of the housing part can be brought into contact, under preload, with the other edge portion. The invention also relates to a table, comprising a tabletop and a table frame of this type. The table frame may be used in a table having a tabletop.

17 Claims, 6 Drawing Sheets

(56) References Cited

U.S. PATENT DOCUMENTS

| | | | | | |
|---|---|---|---|---|---|
| 3,986,316 | A * | 10/1976 | Blodee | F16B 12/02 | 403/231 |
| 4,573,415 | A * | 3/1986 | Ramey | A47B 3/0815 | 248/188 |
| 9,427,080 | B2 * | 8/2016 | Wu | A47B 3/002 | |
| 9,765,803 | B2 * | 9/2017 | Aninos | A47B 91/02 | |
| 9,993,067 | B2 * | 6/2018 | Lu | A47B 9/00 | |
| 10,004,326 | B2 * | 6/2018 | Randløv | F16B 12/52 | |
| 10,405,646 | B2 * | 9/2019 | Tseng | A47B 9/20 | |
| 10,871,187 | B2 * | 12/2020 | Walling | F16C 29/02 | |
| 11,357,320 | B2 * | 6/2022 | Jørgensen | A47B 9/20 | |
| 11,382,414 | B1 * | 7/2022 | Zhang | A47B 3/0818 | |
| 11,684,152 | B2 * | 6/2023 | Zhu | F16B 12/38 | 108/157.1 |
| 2004/0083932 | A1 * | 5/2004 | Kottman | A47B 3/00 | 108/115 |
| 2013/0170904 | A1 * | 7/2013 | Cappelle | F16B 12/04 | 403/381 |
| 2017/0135466 | A1 * | 5/2017 | Randløv | A47B 9/04 | |
| 2019/0029413 | A1 * | 1/2019 | Patton | A47B 3/06 | |
| 2019/0200752 | A1 * | 7/2019 | Van Hooft | A47B 21/06 | |
| 2020/0154876 | A1 * | 5/2020 | Liu | A47B 9/00 | |
| 2022/0273095 | A1 * | 9/2022 | Nonnenmacher | A47B 3/12 | |

FOREIGN PATENT DOCUMENTS

| | | | | | |
|---|---|---|---|---|---|
| CN | 211722220 | U | * | 10/2020 | A17B 13/02 |
| CN | 112628278 | A | * | 4/2021 | A47B 13/003 |
| CN | 109700174 | B | * | 12/2021 | A47B 13/003 |
| CN | 114587065 | A | * | 6/2022 | A47B 13/08 |
| DE | 20 2011 002 647 | U1 | | 6/2011 | |
| DE | 202019104799 | U1 | * | 10/2019 | A47B 38/08 |
| FR | 2704283 | A1 | * | 10/1994 | A47B 13/02 |
| GB | 2598887 | A | * | 3/2022 | A47B 13/02 |
| KR | 20150034937 | A | * | 4/2015 | A47B 13/02 |
| KR | 101581833 | B1 | * | 1/2016 | A47B 13/02 |
| TW | M486995 | U | * | 10/2017 | A47B 19/08 |
| TW | 1788178 | B | * | 12/2022 | A47B 13/02 |
| WO | 2018/093323 | A1 | | 5/2018 | |
| WO | 2019/174686 | A2 | | 9/2019 | |
| WO | WO-2022263284 | A1 | * | 12/2022 | G01B 21/32 |

* cited by examiner

TABLE FRAME AND TABLE

CROSS-REFERENCE TO RELATED APPLICATIONS

This continuation application claims priority to PCT/EP2021/072778 filed on Aug. 17, 2021 which has published as WO 2022/048903 A1 and also the German application number 10 2020 211 087.5 filed on Sep. 2, 2020, the entire contents of which are fully incorporated herein with these references.

FIELD OF THE INVENTION

The invention relates to a table frame having a table leg with a housing part, a longitudinal beam and a transverse beam with two opposite edge portions. The invention further relates to a table having such a table frame.

BACKGROUND OF THE INVENTION

A table frame of the type mentioned at the beginning is known, for example, from WO 2019/174686 A2.

In the table frame known from WO 2019/174686 A2, a transverse beam has a projecting flange on the top of a side wall and a bracket on the bottom. The bracket has a portion projecting at right angles from the side wall, which ends at its free end in a flange at right angles to it. The side wall of the transverse beam has slots on both sides of the bracket. For installation of the transverse beam on a longitudinal beam, the right-angled flange of the bracket is inserted into a transverse slot on the underside of the longitudinal beam, while the slots in the side wall of the transverse beam overlap projecting flanges on side walls of the longitudinal beam.

A table leg of the table frame known from WO 2019/174686 A2 has a U-shaped mounting clamp in which the longitudinal beam can be received. The longitudinal beam has a pair of stub axles on the outside, which interact with return recesses on the inside end of the table leg mounting clamp. To fix the table leg to the longitudinal beam, two spring-loaded catches from the longitudinal beam engage in two slots of the mounting clamp.

SUMMARY OF THE INVENTION

Object of the Invention

It is an object of the invention to make the installation of a table with a table frame simple and reliable.

Description of the Invention

This object is solved in accordance with the invention by a table frame in accordance with claim 1 and a table in accordance with claim 15. Advantageous embodiments are given in the subclaims.

According to the invention, a table frame is provided. The table frame has a table leg with a housing part. The table frame also has a longitudinal beam. The longitudinal beam typically extends in a longitudinal direction from the table leg to another table leg of the table frame. Furthermore, the table frame has a transverse beam with two mutually opposite edge portions. The housing part of the table leg serves to connect the table leg with the longitudinal beam and the transverse beam. In the assembled state, the housing part can overlap the longitudinal beam and/or engage in the longitudinal beam. The transverse beam and the table leg are typically located at one end of the longitudinal beam.

When the table frame is assembled, a tabletop can be arranged on the top of the transverse beam and/or the longitudinal beam. The longitudinal beam and the transverse beam (when the table frame is assembled) can together form a contact surface for the tabletop.

For the purposes of describing the present invention, directional indications such as up or down refer to a position of use of the table frame or a table with the table frame.

According to the invention, a longitudinal beam protrusion of the transverse beam can be brought into contact with one of the edge portions of the transverse beam under preload and a housing protrusion of the housing part can be brought into contact with the other edge portion under preload.

For installation of the table frame, the longitudinal beam, the transverse beam and the table leg can first be brought into an intermediate assembly state in which the aforementioned components are pre-positioned relative to one another. Advantageously, the longitudinal beam, the transverse beam and the table leg can be aligned relative to one another without requiring any special force. Further, the intermediate assembly state can advantageously be set up without tools.

In the assembled state of the table frame, the longitudinal beam protrusion and the housing protrusion rest under preload against the opposite edge portions of the transverse beam. In other words, the transverse beam is braced to the longitudinal beam and the table leg via the longitudinal beam protrusion and the housing protrusion. The preload or bracing holds the transverse beam to the longitudinal beam and the table leg. The table frame can then be handled, for example for the installation of a tabletop, without the transverse beam becoming detached from the longitudinal beam. Advantageously, no tools are required to clamp the transverse beam to the longitudinal beam protrusion and the transverse beam protrusion.

The longitudinal beam protrusion typically extends in a longitudinal direction of the longitudinal beam away from a central portion of the longitudinal beam. When assembled, the housing protrusion may extend substantially parallel to the longitudinal beam protrusion. Typically, the housing protrusion projects from the housing part perpendicular to a leg axis (vertical in the use position) of the table leg.

The two edge portions may extend in a straight line. Typically, the two edge portions run in the horizontal direction when the table frame is in the position of use. Alternatively, the edge portions may be curved. In particular, the edge portions may be concave towards the respective protrusion.

Advantageously, the two edge portions together delimit a recess in the transverse beam. In other words, the two edge portions of the transverse beam may border the same recess. The recess may be bounded by further edge areas of the transverse beam. When assembled, the longitudinal beam protrusion and the housing protrusion (also referred to collectively as the protrusions) engage into the recess. Preferably, the longitudinal beam protrusion and/or the housing protrusion protrude through the recess. By making the recess in the transverse beam, the edge portions can be provided on the transverse beam in a simple and precise manner. The engagement of the protrusions in the recess can also further simplify installation. In particular, the transverse beam can already be held in the intermediate assembly state by one of the protrusions, particularly the longitudinal beam protrusion.

The longitudinal beam protrusion and/or housing protrusion may have a hook portion. The hook portion can engage behind the respective associated edge portion of the transverse beam. The transverse beam can then be held particularly securely.

The longitudinal beam may have a retaining projection for engaging in a retaining recess of the transverse beam. The retaining projection advantageously extends transversely to the longitudinal beam protrusion. Preferably, the retaining projection projects toward a contact surface for a tabletop. In other words, the retaining projection can project upward or away from the table leg from the longitudinal beam. The engagement of the retaining projection in the retaining recess means that the transverse beam is held particularly securely on the longitudinal beam.

In a particularly preferred embodiment of the table frame, the table leg is pivotable relative to the longitudinal beam. This allows the table leg to be rotated (pivoted) relative to the longitudinal beam for installation. By pivoting the table leg, the transverse beam can be braced between the longitudinal beam protrusion and the housing protrusion in a particularly simple manner. In addition, the pivoting movement can create a leverage effect that increases the contact forces of the protrusions on the edge portions. As a result, the transverse beam is held even more reliably when mounted.

A pivot axis between the longitudinal beam and the table leg can be formed with a pin. On the one hand, the pin can define the pivot axis. On the other hand, the pin can serve as an abutment to support the longitudinal beam against the table leg. Preferably, the pin is located on the housing part of the table leg. The pin can be formed, for example, by a rivet or a screw. This simplifies the manufacturing process.

An end section of a slot can serve for abutment of the pin. On the other end, the slot is generally open. During installation, the pin is first inserted into the slot and then advanced to the (closed) end section. When the pin has reached the end section, the table leg and the longitudinal beam are pivoted against one another until the table leg reaches a final position. In this manner, the installation can be performed particularly easily and, in particular, without tools. In the assembled state, the pin advantageously remains in the end section. When mounted, the table leg is generally in the final position relative to the longitudinal beam.

The slot may be curved. This allows the pin to be supported substantially orthogonally on the edge of the slot when loaded, particularly when loaded by the preload force on the housing protrusion. It is therefore possible to prevent the pin from moving in the slot and away from the end section under load.

Preferably, the slot is formed in a side wall of the longitudinal beam. This simplifies the manufacturing process. The slot can be obtained, for example, by punching or laser cutting.

Preferably, a stop for the pivoting movement is set up between the housing part and the longitudinal beam. On the one hand, the stop can ensure that the table leg is in a final position (corresponding to a functional position) when mounted, typically at right angles to the longitudinal beam. On the other hand, the stop can determine the magnitude of preload force exerted by the protrusions.

The stop may be formed with a projection and return recess. In particular, if the return recess extends transversely to the longitudinal direction of the longitudinal beam, the stop can also simultaneously secure a longitudinal position of the table leg relative to the longitudinal beam. When the pivot axis is established by abutment of a pin against an end section of a slot, the projection engaging the return recess can ensure that the pin remains in the end section of the slot when assembled.

Preferably, the return recess is formed in a side wall of the longitudinal beam, for example punched or cut into the side wall. The projection may be formed by a rivet or a screw. This further simplifies production. If the projection is formed by a screw, the end position of the pivoting movement can be secured by tightening the screw.

Preferably, the table leg can be latched to the longitudinal beam. The table leg can be fixed to the longitudinal beam in its position required for use of the table frame (in particular a final position of a pivoting movement) by the latching action. In the latched (i.e., assembled) state of the table leg, the longitudinal beam protrusion and the housing protrusion rest against the edge portions of the transverse beam under preload. Latching can be set up particularly easily, particularly without tools. For disassembly of the table frame, the latching can be released by suitable manipulation.

A latching element can be rotatably held on the longitudinal beam to latch the table leg. Preferably, the latching element is supported on the longitudinal beam by a spring element. The latching element can be a bracket. In this manner, a reliable latching mechanism can be set up with little manufacturing effort. In particular, a latching element designed as a bracket can ensure the accessibility of electrical connections of a motor arranged in the housing part for adjusting the length of the table leg. In addition, a rotatable latching element can be easily deflected manually against the spring action to release the latching. A release lever can be provided on the latching element for this purpose.

The housing part may have a setback for engaging behind with a latching tab. This can be advantageous with regard to the stiffness of the latched connection of the housing part to the longitudinal beam. The latching tab is preferably formed on a latching element, in particular in the form of a bracket, which is rotatably held on the longitudinal beam.

The housing protrusion can preload the transverse beam away from a contact surface for a tabletop. In other words, the housing protrusion can tension the transverse beam downward. If the table leg can be pivoted relative to the longitudinal beam, a pivot axis can be arranged in a laterally outer area of the longitudinal beam and the housing part for this purpose. When the housing protrusion tensions the transverse beam away from the contact surface, the longitudinal beam protrusion tensions the transverse beam toward the contact surface (upward). If the longitudinal beam has an upwardly projecting retaining projection, the transverse beam can then be positioned on the longitudinal beam with substantially no resistance. For this purpose, the transverse beam can be put on the longitudinal beam protrusion and then pivoted to bring the retaining projection into engagement with the retaining recess. The transverse beam is then fixed by means of the housing protrusion (e.g., by pivoting the table leg to its final position). The installation can therefore be done easily and with little effort.

The table leg can be adjustable in length. By adjusting the length of the table leg, a height of a table with the table frame can be set.

Preferably, a motor for adjusting the length of the table leg is arranged in the housing part. The housing part then serves on the one hand to connect the table leg, the longitudinal beam and the transverse beam to one another. On the other hand, the housing part also serves to hold and support the motor. A compact design with low material usage can thus be obtained.

Preferably, the transverse beam has two further edge portions opposite one another, and a further longitudinal beam protrusion of the longitudinal beam can be brought into contact with one of the further edge portions under preload and a further housing protrusion of the housing part can be brought into contact with the other further edge portion under preload. The additional protrusions allow the transverse beam to be held particularly reliably. The further protrusions are typically spaced from the (first) protrusions transversely to a longitudinal direction of the longitudinal beam. The further protrusions are typically formed like the (first) protrusions.

A further table leg and a further transverse beam can be formed like the (first) table leg and the (first) transverse beam and can be connected to the longitudinal beam. The further transverse beam and the further table leg are generally arranged at a second end of the longitudinal beam. The additional table leg can improve the stability of the table. The further transverse beam can improve the support of a tabletop to the table frame.

Further within the scope of the present invention is a table having a tabletop and a table frame described above in accordance with the invention. When assembled, the tabletop may be attached to the transverse beam(s) and/or the longitudinal beam. Due to the advantages described above regarding the installation of the table frame according to the invention, the table frame can be (pre-)assembled independently of the tabletop. Then the tabletop can be attached to the table frame. In particular, the table frame can be placed on the tabletop (lying with its upper side facing downwards) and connected to it in a suitable manner. By bracing the transverse beam(s), there is no risk of it/they coming loose from the longitudinal beam during handling of the pre-assembled table frame.

Further features and advantages of the invention can be found in the description and the drawings. According to the invention, the aforementioned features and those which are to be explained below can each be used individually or as a plurality in expedient combinations of any kind. The embodiments shown and described are not to be understood as an exhaustive list, but, rather, have an exemplary character for the description of the invention.

BRIEF DESCRIPTION OF THE DRAWINGS

The invention is shown in the drawing and is explained in more detail with reference to an example of an embodiment. In the drawings.

DETAILED DESCRIPTION OF THE PREFERRED EMBODIMENTS

Figure 1:
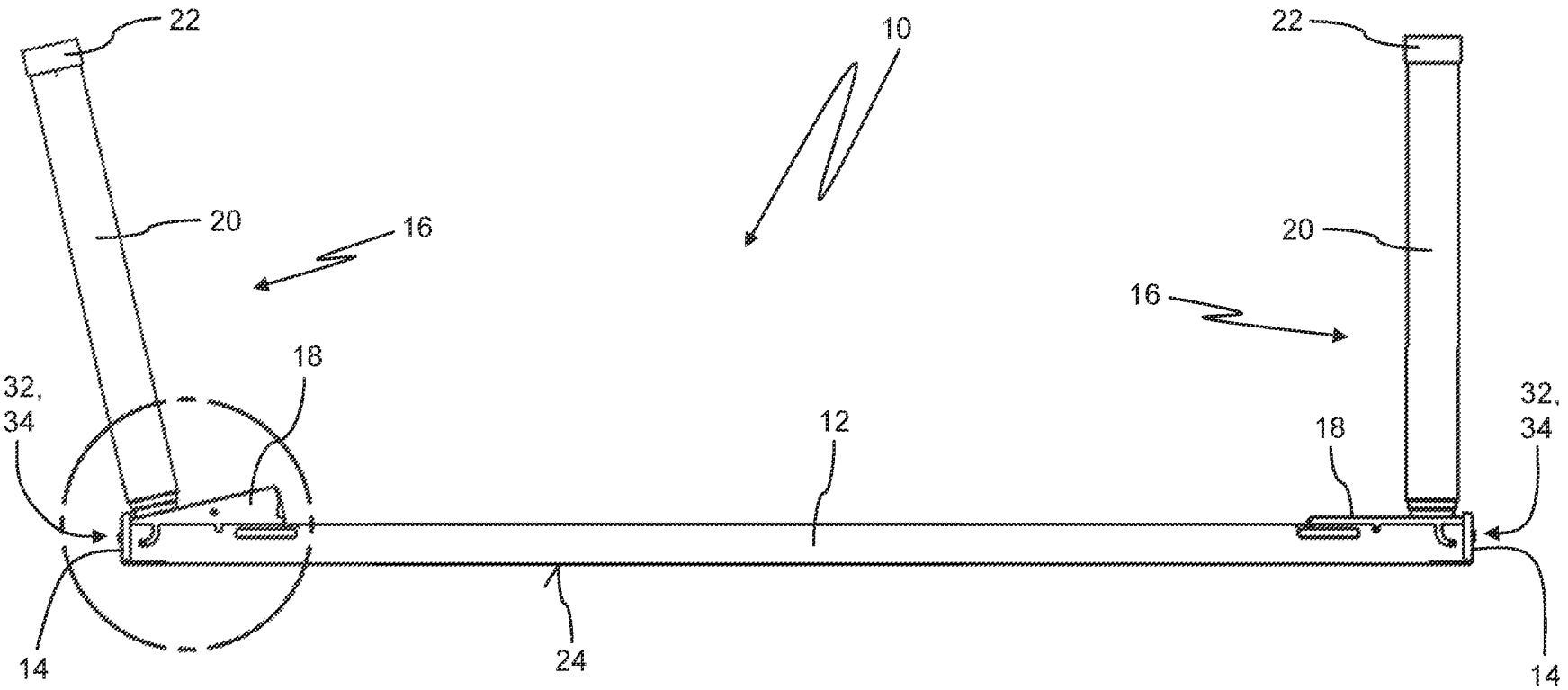
FIG. 1 is a schematic side view of a table frame according to the invention having a longitudinal beam, two table legs each with a housing part and two transverse beams, one of the table legs being in an assembled state and the other table leg being in an intermediate state during its installation.
Figure 2:
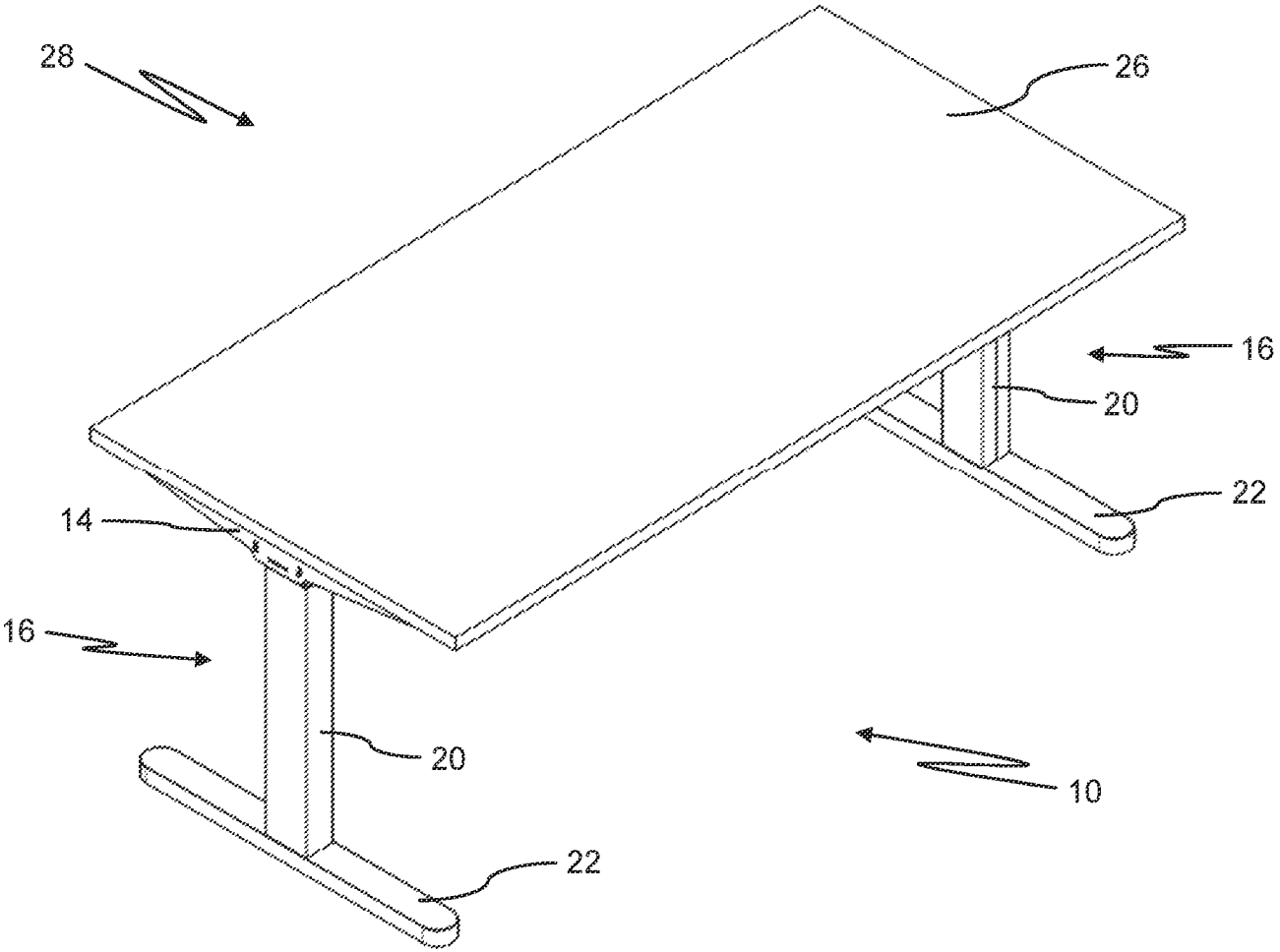
FIG. 2 is a schematic perspective view of a table according to the invention with a tabletop held on the table frame of FIG. 1.

FIG. 1 shows a table frame 10. The table frame 10 has a longitudinal beam 12. A transverse beam 14 of the table frame 10 is arranged at both ends of the longitudinal beam 12. Further, a table leg 16 of the table frame 10 is arranged at each end of the longitudinal beam 12. The table legs 16 each have a housing part 18. Further, the table legs 16 may each have a column portion 20 and a leg portion 22. The table leg 16 on the left in FIG. 1 is shown during its installation. The table leg 16 on the right in FIG. 1 and the associated transverse beam 14 are shown in an assembled state. In the assembled state, the longitudinal beam 12 and the two transverse beams 16 form a contact surface 24 for a tabletop 26 of a table 28, compare FIG. 2.

Figure 3:
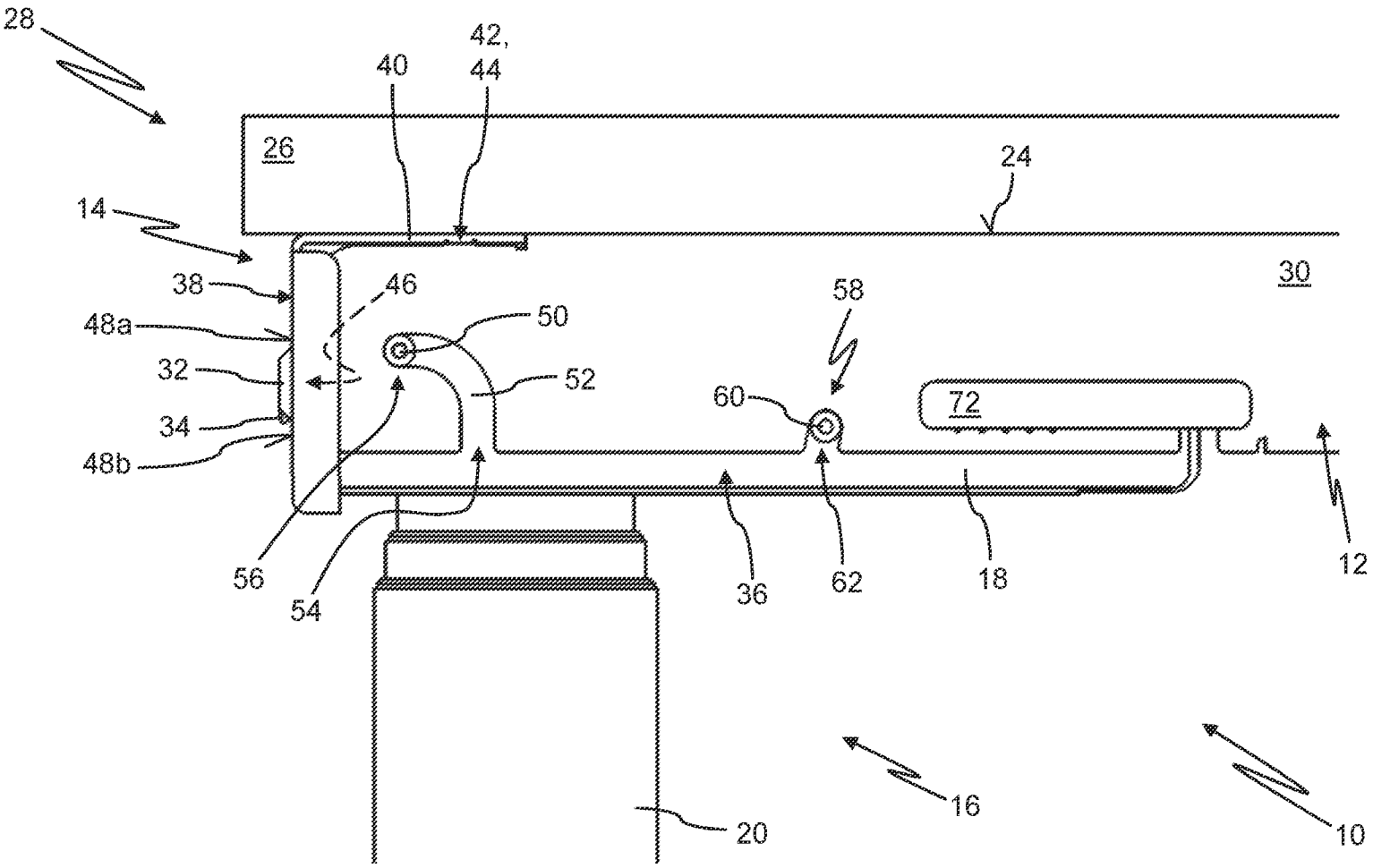
FIG. 3 is an enlarged schematic side view of the table of FIG. 2 in the area where the longitudinal beam is connected to one of the transverse beams and one of the table legs.
Figure 5:
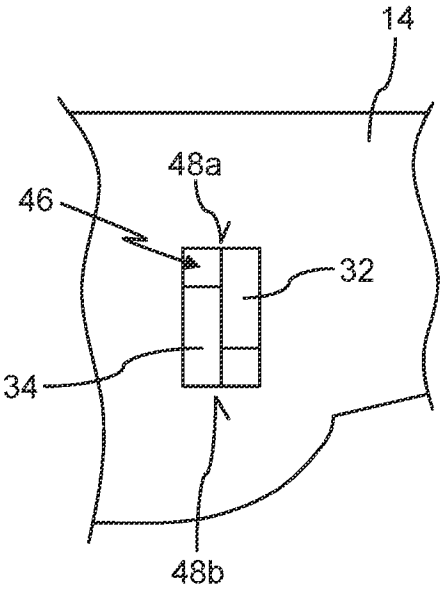
FIG. 5 a further enlarged schematic detail of FIG. 4 in the area of one of the recesses in the transverse beam in which one of the longitudinal beam protrusions and one of the housing protrusions engage.
Figure 4:
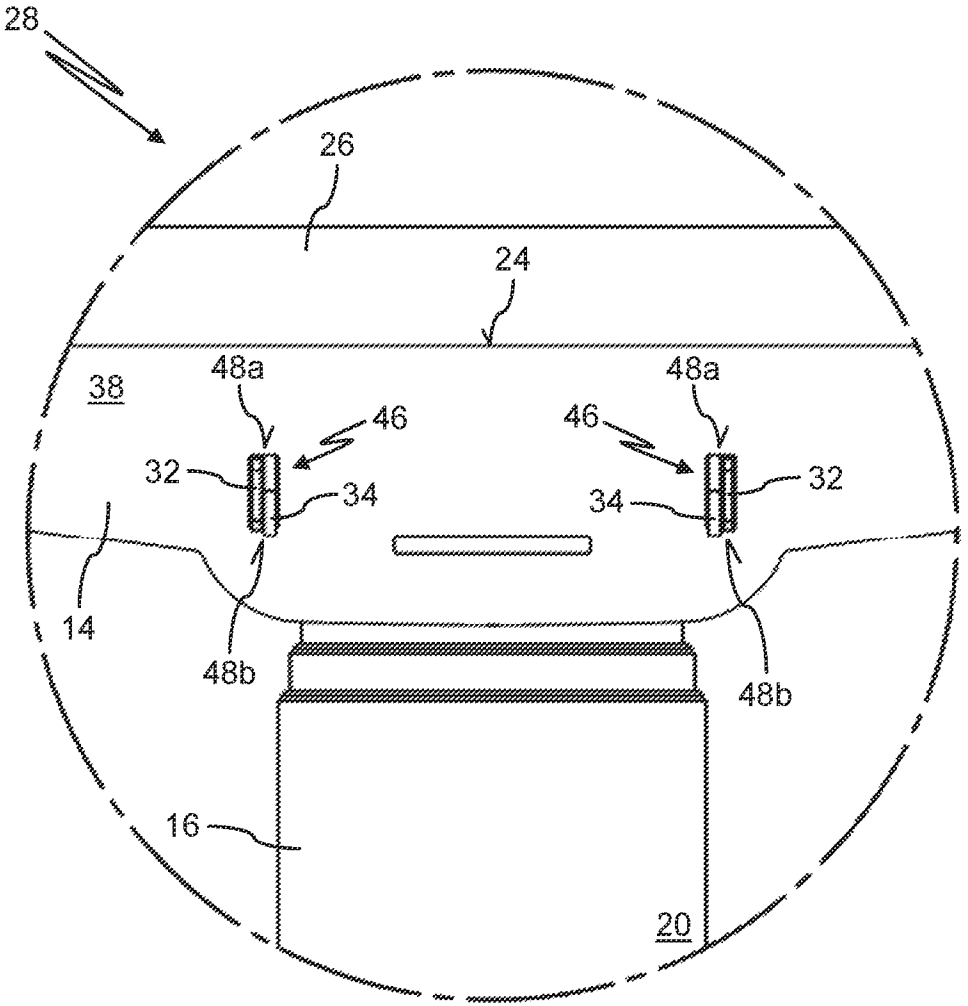
FIG. 4 is an enlarged schematic detail view of the table of FIG. 2, looking at an end face along which one of the transverse beams extends, showing that two longitudinal beam protrusions and two housing protrusions respectively abut opposite edge portions of two recesses in the transverse beam.
Figure 6:
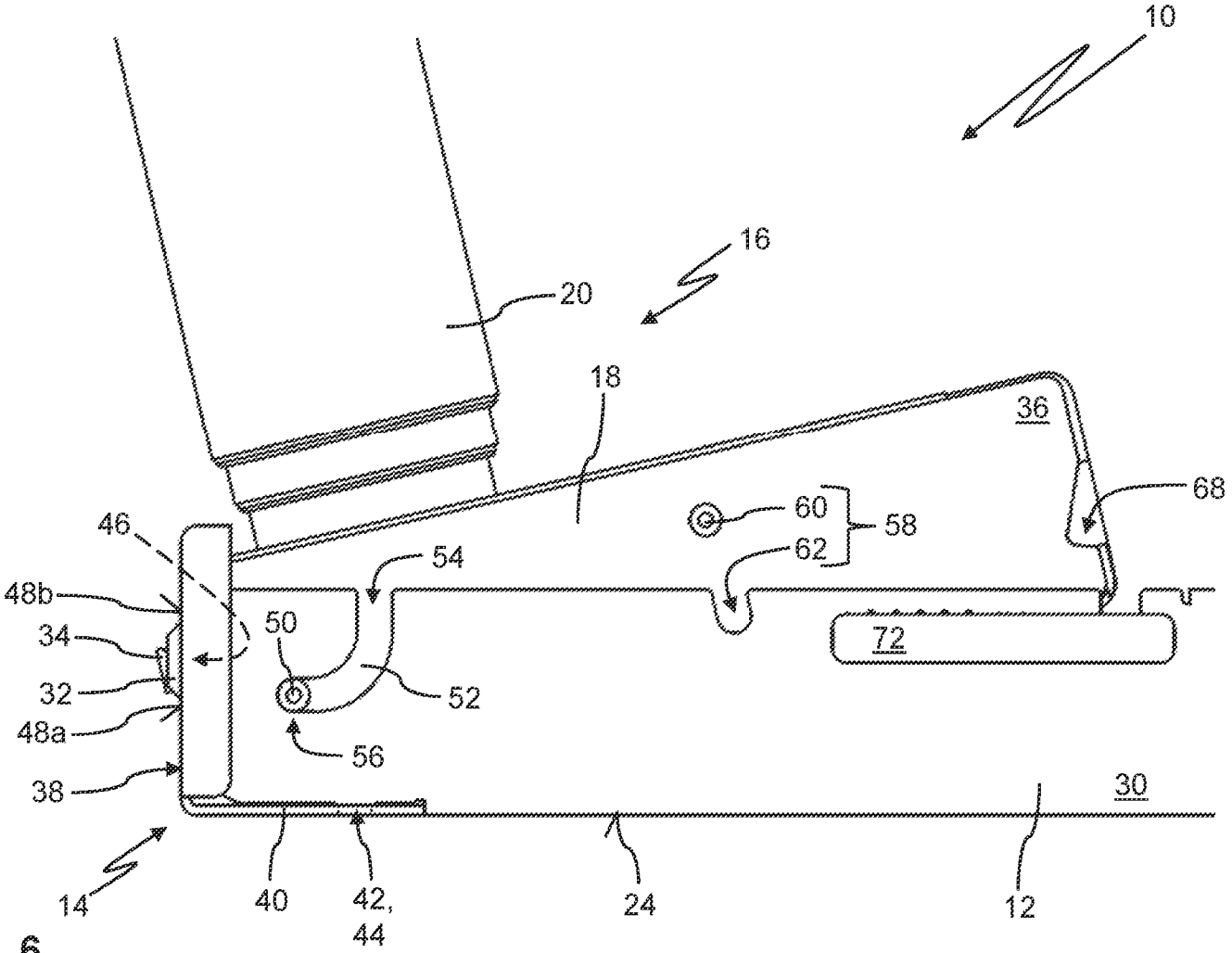
FIG. 6 is an enlarged schematic side view of the table frame of FIG. 1 during installation of one of the table legs, wherein a pin abutting an end section of a slot forms a pivot axis for the table leg and wherein the longitudinal beam protrusion and the housing protrusion extend through the transverse beam.
Figure 7:
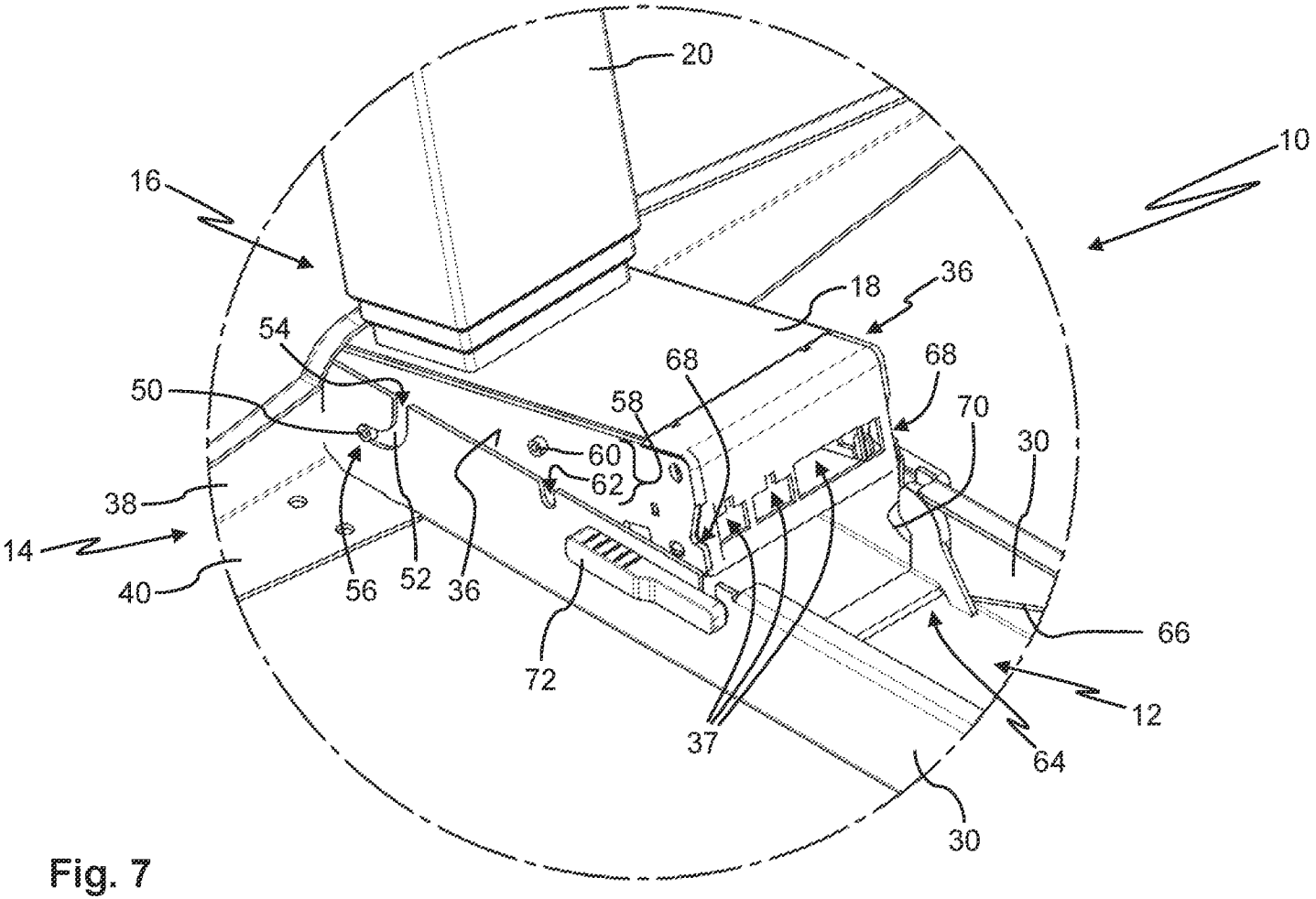
FIG. 7 is a schematic perspective view of the arrangement of FIG. 6, showing a latching mechanism with a spring-loaded latching element in the form of a bracket and with setbacks on the housing part.

FIGS. 3, 4 and 5 show detailed views of the assembled table frame 10 or table 28 in the area where the longitudinal beam 12 is connected to one of the transverse beams 14 and one of the table legs 16. FIGS. 6 and 7 show detailed views of the table frame 10 during installation of one of the transverse beams 14 and one of the table legs 16 to the longitudinal beam 12.

The present longitudinal beam 12 has two side walls 30. In particular, the longitudinal beam 12 can be U-shaped in cross-section, see FIG. 7. The longitudinal beam 12 has two longitudinal beam protrusions 32. The longitudinal beam protrusions 32 each project from one of the side walls 30, compare in particular FIGS. 3 and 6. Transverse to a longitudinal direction of the longitudinal beam 12, the longitudinal beam protrusions 32 are spaced apart, compare FIG. 4. The longitudinal beam protrusions 32 may be formed integrally with the respective side walls 30. In particular, the longitudinal beam 12 can be formed in one piece as a whole.

The housing part 18 has two housing protrusions 34. The housing part 18 may be box-shaped with two longitudinal walls 36, compare in particular FIGS. 6 and 7. The housing protrusions 34 may be disposed in extension of the longitudinal walls 36 (in other words, flush with the longitudinal walls 36) on the housing part 18. The housing protrusions 34 and the associated longitudinal wall 36 may each be integrally formed with one another.

The housing parts 18 can each contain a motor, not shown in more detail, with electrical connections 37 (compare FIG. 7) for adjusting the length of the respective table leg 16. The table legs 16 can be telescopic for this purpose.

The transverse beam 14 may have an end wall 38 and a top wall 40. The end wall 38 and the top wall 40 may extend at right angles to one another. The top wall 40 can contribute to form the contact surface 24 for the tabletop 26.

The top wall 40 of the transverse beam 14 may have two retaining recesses 42, compare FIGS. 3 and 6. Two retaining projections 44 of the longitudinal beam 12 can engage the retaining recesses 42. The retaining projections 44 may extend from the longitudinal beam 12, particularly its side walls 30, toward the contact surface 24 for the tabletop 26 (i.e., upward in the use position).

The end wall 38 of the transverse beam 14 has two recesses 46, see in particular FIG. 4. The recesses 46 may be formed as through-going recesses and may, for example, be punched or cut out of the transverse beam 14. Alternatively, the recesses 46 in the transverse beam 14 could be covered in some areas or completely and could, for example, be formed as indentations (not shown).

The recesses 46 are each bounded by two opposing edge portions 48*a*, 48*b*. The edge portions 48*a*, 48*b* are each formed in a straight line here. The edge portions 48*a*, 48*b* may bound the recesses 46 upwardly and downwardly (toward and away from the contact surface 24 for the tabletop 26, respectively). The two edge portions 48*a*, 48*b* of one of the recesses 46 are each arranged here one above the other in the vertical direction.

In an embodiment not shown in greater detail, the edge portions 48*a*, 48*b* could be laterally offset from one another (transverse to the longitudinal direction of the longitudinal beam 12). It is also conceivable that the edge portions each define separate recesses. The two edge portions could delimit a web portion of the transverse beam and, in particular, could be formed on free edges of the transverse beam (not shown in more detail).

To install the transverse beam 14 on the longitudinal beam 12, the longitudinal beam protrusions 32 can first be inserted into the recesses 46. For this purpose, the transverse beam 14 can be tilted about its axis relative to the longitudinal beam 12. Next, the transverse beam 14 can be rotated relative to the longitudinal beam 12 to its position shown in the figures, with the retaining projections 44 engaging the retaining recesses 42.

To fix the transverse beam 14 to the longitudinal beam 12, the housing protrusions 34 of the housing part 18 are inserted into the recesses 46 of the transverse beam 14 (compare in particular FIG. 6) and the table leg 16 with the housing part 18 is brought into its final position relative to the longitudinal beam 12 (compare in particular FIG. 3). In this final position or a mounted state, the longitudinal beam protrusions 32 and the housing protrusions 34 rest under preload against the opposing edge portions 48*a*, 48*b* of the transverse beam 14. Upon installation of the table leg 16 the housing protrusions 34 can be pressed against the lower edge portions 48*b*. The longitudinal beam protrusions 32 can be pressed against the upper edge portions 48*a* upon installation of the table leg 16. The housing protrusions 34 and the longitudinal beam protrusions 32 are therefore supported on the transverse beam 14 in opposite directions. This allows the transverse beam 14 to be held frictionally against the longitudinal beam 12 and the housing part 18.

For the installation of the table leg 16, it can be swiveled in relation to the longitudinal beam 12. Two pins 50 are arranged here on the housing part 18 (compare FIGS. 3, 6 and 7). The side walls 30 of the longitudinal beam 12 each have a curved slot 52. During installation of the table leg 16, the pins 50 are first inserted into open ends 54 of the slots 52. Hereto, the table leg 16 is held at an angle. The table leg 16, which is held at an angle, is then advanced along the slots 52 until the pins 50 rest against a respective end section 56 of the slots 52 and the housing protrusions 34 engage in the recesses 46 of the transverse beam 14. Now the table leg 16 is rotated around a pivot axis running through the two pins 50 while the pins 50 are in contact with the end sections 56 of the slots 52 until it reaches its final position.

The final position of the table leg 16 relative to the longitudinal beam 12 may be defined by a stop 58. Preferably, the stop 58 is established between the housing part 18 and the longitudinal beam 12. The stop 58 may be formed with a projection 60 and a return recess 62, compare FIGS. 3, 6 and 7. The projection 60 may be disposed on the housing part 18. The return recess 62 may be formed in the side wall 30 of the longitudinal beam 12. Here, the return recess 62 extends transversely to a longitudinal direction of the longitudinal beam 12. Due to the engagement of the projection 60 in the return recess 62, the table leg 16 is therefore also positively secured to the longitudinal beam 12 against displacement in the longitudinal direction of the latter, compare FIG. 3.

To hold the table leg 16 in the final position defined by the stop 58, the table leg 16 can be latched to the longitudinal beam 12. A latching element 64 can be rotatable relative to the longitudinal beam 12, compare FIG. 7. The latching element 64 can be a bracket. Alternatively, two separate and independently operable latching elements can be provided, which can be mounted opposite one another on the side walls 30 of the longitudinal beam 12 (not shown in more detail). Here, the latching element 64 is supported on the longitudinal beam 12 by a spring element 66, for example a spring wire. The housing part 18 of the table leg 16 may have setbacks 68. Latching tabs 70 of the latching element 64 are brought into rear engagement behind the setbacks 68 by the spring element 66 when the table leg 16 is in the final position. The latching element 64 with the latching tabs 70 then prevents the table leg 16 from being swiveled back.

To be able to swivel the table leg 16 back for disassembly, the latching can be released manually. For this purpose, a release lever 72 can cooperate with the latching element 64. By actuating the release lever 72, the latching element is rotated against the action of the spring element 66 in such a manner that the latching tabs 70 are guided out of the setbacks 68. The table leg 16 can then be rotated about the pivot axis (compare pin 50) while releasing the tension between the edge portions 48*a*, 48*b* and the longitudinal beam protrusions 32 and the housing protrusions 34 and guided out of the slots 52.

LIST OF REFERENCE SIGNS

Table frame 10
Longitudinal beam 12
Transverse beam 14
Table leg 16
Housing part 18
Column portion 20
Foot portion 22
Contact surface 24
Tabletop 26
Table 28
Side wall 30
Longitudinal beam protrusion 32
Housing protrusion 34
Longitudinal wall 36
Connections 37
End wall 38
Top wall 40
Retaining recess 42
Retaining projection 44
Recess 46
Edge portions 48*a*, 48*b*

Pin 50
Slot 52
Open end 54
End section 56
Stop 58
Projection 60
Return recess 62
Latching element 64
Spring element 66
Setback 68
Latching tab 70
Release lever 72

What is claimed is:

1. A table frame, comprising:

a longitudinal beam;

a transverse beam arranged at an end of the longitudinal beam, the transverse beam having two mutually opposite edge portions which delimit a recess in the transverse beam;

a table leg with a housing part;

wherein a longitudinal beam protrusion of the longitudinal beam can be brought into contact with one of the edge portions under preload; and a housing protrusion of the housing part can be brought into contact with the other edge portion under preload;

wherein the longitudinal beam protrusion and the housing protrusion engage in the recess.

2. The table frame according to claim 1, wherein the housing part is box-shaped with two longitudinal walls and two housing protrusions, wherein the housing protrusions and the associated longitudinal wall are each formed integrally with one another.

3. The table frame according to claim 1, wherein the longitudinal beam has a retaining projection for engaging in a retaining recess of the transverse beam, wherein the retaining projection projects towards a contact surface for a tabletop.

4. The table frame according to claim 1, wherein the table leg is pivotable relative to the longitudinal beam.

5. The table frame according to claim 4, wherein a pivot axis is formed with a pin, wherein the pin is arranged on the housing part of the table leg.

6. The table frame according to claim 5, wherein an end section of a slot serves for abutment of the pin, wherein the slot is formed in a side wall of the longitudinal beam.

7. The table frame according to claim 6, wherein the slot is a curved slot.

8. The table frame according to claim 4, wherein a stop is arranged between the housing part and the longitudinal beam for the pivoting movement.

9. The table frame according to claim 8, wherein the stop is formed with a projection and a return recess.

10. The table frame according to claim 1, wherein the housing protrusion biases the transverse beam away from an abutment surface for a tabletop.

11. The table frame according to claim 1, wherein the table leg can be latched to the longitudinal beam.

12. The table frame according to claim 11, wherein a latching element is rotatably held on the longitudinal beam for latching the table leg, wherein the latching element is supported on the longitudinal beam via a spring element.

13. The table frame according to claim 12, wherein the latching element is a bracket.

14. The table frame according to claim 12, wherein the housing part has a setback for engaging behind with a latching tab.

15. The table frame according to claim 1, wherein a motor for adjusting the length of the table leg is arranged in the housing part.

16. The table frame according to claim 1, wherein the transverse beam has two further mutually opposite edge portions, and wherein a further longitudinal beam protrusion of the longitudinal beam can be brought into contact with one of the further edge portions under preload and a further housing protrusion of the housing part can be brought into contact with the other further edge portion under preload.

17. A table having a tabletop and the table frame according to claim 1.

* * * * *